United States Patent [19]

Cook

[11] Patent Number: 4,674,312

[45] Date of Patent: Jun. 23, 1987

[54] PILGERING APPARATUS

[75] Inventor: Charles S. Cook, Murrysville Boro, Pa.

[73] Assignee: Westinghouse Electric Corp., Pittsburgh, Pa.

[21] Appl. No.: 692,811

[22] Filed: Jan. 18, 1985

[51] Int. Cl.[4] ..... B21B 17/02; B21B 21/02; C21D 9/38

[52] U.S. Cl. ..... 72/208; 29/130; 72/214; 148/147

[58] Field of Search ..... 72/201, 208, 214; 29/130, 447; 148/147

[56] References Cited

U.S. PATENT DOCUMENTS

| | | | |
|---|---|---|---|
| 417,669 | 12/1889 | Edelen | 72/357 |
| 3,650,138 | 3/1972 | Persico | 72/208 |
| 4,112,812 | 9/1978 | Wardwell et al. | 148/147 |
| 4,184,352 | 1/1980 | Potapov et al. | 72/208 |
| 4,233,834 | 11/1980 | Matinlass et al. | 72/208 |

FOREIGN PATENT DOCUMENTS

| | | | |
|---|---|---|---|
| 557832 | 5/1977 | U.S.S.R. | 72/214 |

*Primary Examiner*—Lowell A. Larson
*Assistant Examiner*—Steve Katz

[57] ABSTRACT

Pilgering apparatus for reducing a tube particularly of zirconium alloy. The reduction is effected by grooved annular dies. Each die has a recess in its bore extending between the surfaces on which the die is mounted on the shaft on which it is rotated. Under the pressure applied to reduce the tube, the die is flexed. As a result of the flexing tension exists in the die in the volume near the recess and pressure is developed in the volume near the groove in which the tube is engaged. The pressure counteracts the tension resulting from the tube-reducing pressure. Each die is case hardened in the region of its grooves but not in the region of the recess.

6 Claims, 14 Drawing Figures

HARDNESS TRAVERSES ON RADIAL SECTION THROUGH TOP DIE AT GROOVE STATION 0.25

HARDNESS TRAVERSES ON RADIAL SECTION THROUGH BOTTOM DIE AT GROOVE STATION 0.70

HARDNESS TRAVERSES ON RADIAL SECTION THROUGH BOTTOM DIE AT GROOVE STATION 0.20

HARDNESS TRAVERSES ON RADIAL SECTION THROUGH TOP DIE AT GROOVE STATION 0.7

PILGERING APPARATUS

BACKGROUND OF THE INVENTION

This invention relates to the cold forming, rolling, or reducing art and it has particular relationship to pilgering for reducing the cross sectional dimensions of tubes.

Fuel elements for nuclear reactors, particularly of the pressurized-water type (PWR) include a plurality of pellets of a compound of uranium or other fissionable material in cladding of a Zircaloy alloy, for example, Zircaloy-4 alloy. The cladding is a tube in which the pellets are deposited and which is seal welded at each end. In the fabrication of the cladding tube, a hollow cylinder of the alloy is originally produced by hot extrusion. The hot extruded tube is reduced in cross sectional dimensions (diameter and wall thickness) by multiple pilger reductions at essentially room temperature. Typically the tube has an outer diameter of 0.7 inch and a wall thickness of 0.070 inch before the last pilger reduction. It is necessary that the OD and the wall thickness be substantially reduced, typically to 0.375 inch and 0.023 inch, respectively, in the last pilger reduction. In reducing tubes of other materials than zirconium alloy for use as cladding, the initial reduction may take place by pilgering and the final reduction can be effected by cold drawing. Because of the texture requirements imposed on Zircaloy-4 alloy and other zirconium alloys used for cladding the final drawing 252,238 operation is not feasible. The reduction of the hot extruded tube must be effected entirely by multiple pilger reductions to final size. Typically five pilgering operations are required to effect the typical reduction described above from the hot extruded tube to final tube size with intermediate annealing and chemical cleaning treatments.

Pilgering apparatus or pilger mills are described in Potapov et al. U.S. Pat. Nos. 4,184,352 and Matinlassi, 4,233,834. The pilgering apparatus includes a tapered mandrel on which the tube to be pilgered is mounted. There are also typically annular or ring dies. Each die has a peripheral circular groove of circularly arcuate, typically semi-circular, cross section. The transverse radius of the groove decreases progressively from a predetermined first point on the circumference to a predetermined second point which typically is substantially less than 360° from the first point. The dies are mounted cooperatively rotatable on a roll stand or yoke. The yoke is oscillated forwardly and backwardly and the dies rotate in synchronism with the oscillations. As the dies rotate, their treads on the periphery are brought into tangency progressively around the periphery of the groove. The dies are so positioned on the roll stand that at each point of tangency the radius of the transverse cross section of the groove on one die is substantially equal to the corresponding radius of the other die. As the dies are rotated their grooves define a circular channel of progressively increasing or decreasing transverse cross section depending on the direction of rotation. The tapered mandrel with the tube mounted on it is inserted in this channel. The tube is advanced a short distance over the mandrel in steps following each full cycle of oscillation of the yoke. At the same time both the tube and the mandrel are rotated about their common axis typically by about 50°. The pilgering process is similar, in its coaction between the tube to be reduced, the mandrel contained therein, and the die grooves to conventional sheet metal rolling.

The dies apply high pressure to the tube during the reduction. During the final, usually the fifth, pilger operation the pressure is typically about 200,000 pounds per square inch. To withstand this pressure the dies are composed of high strength tool steel, typically Bofors SR1855 which has the following nominal composition in weight percent:

Carbon—1.00
Manganese—0.80
Silicon—1.5
Chromium—1.00
Iron—Balance

Typically the mandrel is composed of another high-strength steel such as AISI-A8.

In the reduction of tubes of zirconium alloys by pilgering failure of the dies has been experienced. The failure was manifested first in spalling of the dies particularly before the dies were composed of the high strength SR1855 steel. Later the higher strength dies failed by developing cracks.

It is an object of this invention to overcome the above-described disadvantages and to provide pilgering apparatus and dies for such apparatus in whose use spalling and cracking of the dies shall be precluded or minimized.

SUMMARY OF THE INVENTION

This invention arises in part from the discovery of the causes of the failure of the dies. Each die is rotatable by a shaft which is journaled in a bearing supported in the yoke with the rotational position controlled by a pinion gear at one end of each shaft. The pinion gear engages a stationary rack mounted on the machine frame. The die is fabricated with a bore of smaller diameter than the shaft and is shrunk onto the shaft. Reactive compression is exerted by the shaft on the die. The reducing of a tube, particularly during the final pilgering operation, produces high compressive pressure in the die groove. Spalling is produced by this very high pressure in dies of lower-strength alloys such as AISI-H13. The spalling is minimized by fabricating the dies of higher strength steel such as Bofors SR1855. However, the die is also subject to simultaneous tensile stress in the region of the groove. This tensile stress results from the pressure exerted against the walls of the grooves which tends to open the groove. This pressure may be resolved into components radially of the die axis and axially of the die axis. These components produce axial tension in the region of the groove. Since the pressure applied during the reducing is high, this tension is high. Because the die is of high strength, its toughness is low and therefore its resistance to tensile stress is relatively low and there is a tendency for the die to fail. This tendency is exacerbated by the impressing of the tensile stress intermittently as the roll stand is oscillated back and forth. During the final pilger operation for zirconium alloys, the oscillation is typically at the rate of 240 oscillations per minute. Under the intermittent tensile stress the metal becomes fatigued and the tendency to fail is enhanced. The resistance of the die to failure is further reduced by the simultaneous existence of the above compressive and tensile stresses. The simultaneous existence of compressive and tensile biaxial stresses serves to reduce the strength of a metal according, for example, to the Von Mises yield criteria. Please see Dieter, G. E., *Mechanical Metallury,* Chapter 3, "Elements of the Theory of Plasticity", pgs. 54–77, McGraw-Hill Book Co., 1961. Thus the stress environment in which a pilger die groove operates is extremely hostile due to the high compressive stress level, the cyclic nature of the stresses causing fatigue, and the coexistence of both compressive and tensile stresses. The compressive stresses are a consequence of the tube reduction being performed and thus can only be modified by changing the material, groove design, or reducing the total reduction being performed. Therefore, for a given pilger reduction an improvement in die life or an improvement in its resistance to failure must be achieved by resisting the coexisting tensile stress in the groove. The purpose of this invention is to reduce these tensile stresses and thus improve die life.

In accordance with this invention each die is flexed under the tube-reducing force which is applied between the dies. The flexing is achieved by providing a recess in the surface of the bore. The recess permits the die to flex under the reducing force. When the die flexes, the fibers in the area of the groove where the working pressure is applied are compressed while the fibers in the area of the recess in the bore opposite to the groove are tensioned. The compressive pressure counteracts the tension on the die produced by the stress between the tube and the die minimizing the tendency of the die to fail. The die is case hardened only at the level of the groove and not in the region of the recess. The case hardening produces compressive stress in the region of the groove which also counteracts the tensile stress in this region. The reason for this is that the hardening converts the steel into martensite which tends to cause the steel in the hardened region to expand. This expansion is resisted by the unhardened region of the steel which then produces compression in the case hardened region. If the die is through hardened, the die as a whole expands exacerbating the tension effect.

BRIEF DESCRIPTION OF THE DRAWINGS

For a better understanding of this invention, both as to its organization and as to its method of operation, together with additional objects and advantages thereof, references made to the following description, taken in connection with the accompanying drawings, in which:

FIGS. 7 and 8 show dimensions in inches for a typical die according to this invention for the final operation in reducing a typical tube as described above. These dimensions are shown not with any intention of any way restricting the scope of this invention but to aid those skilled in the art in practicing this invention.

DETAILED DESCRIPTION OF THE PREFERRED EMBODIMENTS

Figure 1:
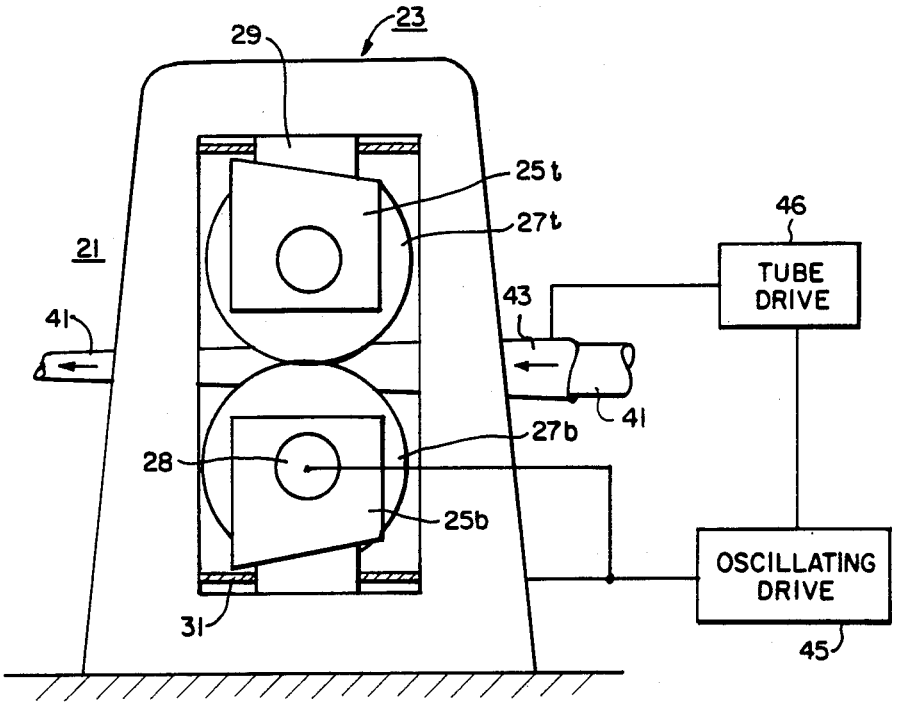
FIG. 1 is a view in side elevation, partly diagrammatic, showing pilgering apparatus in which this invention is integrated.

FIG. 1 shows pilgering apparatus 21 which embodies this invention. The apparatus 21 includes a vertical roll stand or yoke 23 having a top bearing 25*t* and a bottom bearing 25*b*. A top die 27*t* and a bottom die 27*b* are mounted in the bearings 25*t* and 25*b*, respectively. Each die 27*t* and 27*b* is shrunk onto a shaft 28 which is journaled rotatably in the bearing 25*t* and 25*b* and which when driven rotates the dies. The bearings 25*t* and 25*b* are tapered at the top and bottom. Each tapered surface is engaged by a wedge 29 whose horizontal position along the tapered surface of the bearing is adjustable by a bolt 31.

Figure 2:
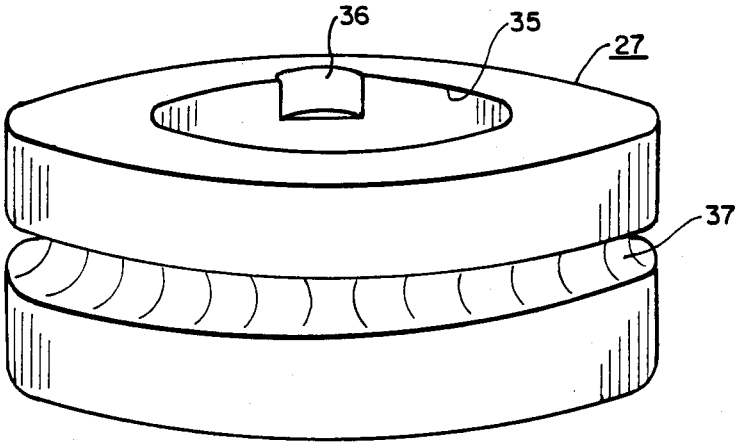
FIG. 2 is a copy of a photograph of a die included in the apparatus shown in FIG. 1.

Each die 27 (FIG. 2) is an annular roll or ring having a bore 35 internally and a tapered groove 37 of circular configuration along its external periphery. The bore 35 has a keyway 36 for engagement by a key (not shown) on shaft 28 to suppress any tendency of rotation of the die relative to the shaft when the die is subject to high pressure in operation. The transverse cross section of the groove 37 at each position along the periphery of the die 23 is a circular arc, usually a semi-circular arc. Over at least a portion of the periphery the radius of the arc varies from a magnitude slightly greater than the starting OD of the tube to be reduced to a smaller magnitude slightly less than the OD of the tube following reduction. The groove extends beyond the taper from the smaller-radius end for an appreciable distance. This extension is called the "sizing area". The groove also extends from the larger-radius end of the taper. At this end the radius of the groove is enlarged to prevent tube/tool contact and to facilitate feeding of the tube. The cylindrical surface of the die extending from the groove is called the tread and the sides of the die are called the flanks.

The pilgering apparatus 21 also includes a tapered mandrel 41 which carries the tube 43 to be reduced. As the dies are rotated on the shafts 28, they are progressively brought into tangency at the edges of their grooves defining a channel of circular section between the grooves. The mandrel 41 and tube 43 extend into this channel.

The pilgering apparatus 21 includes a drive 45 for oscillating the roll stand 23 and the parts mounted on it forwardly and backwardly. The drive 45 may be a crank assembly such as the assembly 7 of Matinlassi. Typically the frame of the machine carries a stationary rack (not shown) which engages a pinion (not shown) on one end of the shaft 28 of each of the dies 27. One die, say 27*t*, is rotated clockwise and the other 27*b* counterclockwise in pressure contact with tube 43 on the forward stroke of the roll stand 23 and the one die 27*t* is rotated counterclockwise and the other 27*b* clockwise in pressure contact with tube 43 on the backward or return stroke of the roll stand 23. The pressure may be adjusted by moving the wedges 29 in one direction or the other. There is also a drive 46 for advancing the tube. The tube 43 is advanced a short distance following each period of the oscillations. In the case of the typical tube described above, the advance is 0.050 inch for each of the 240 oscillations per minute.

Figure 3:
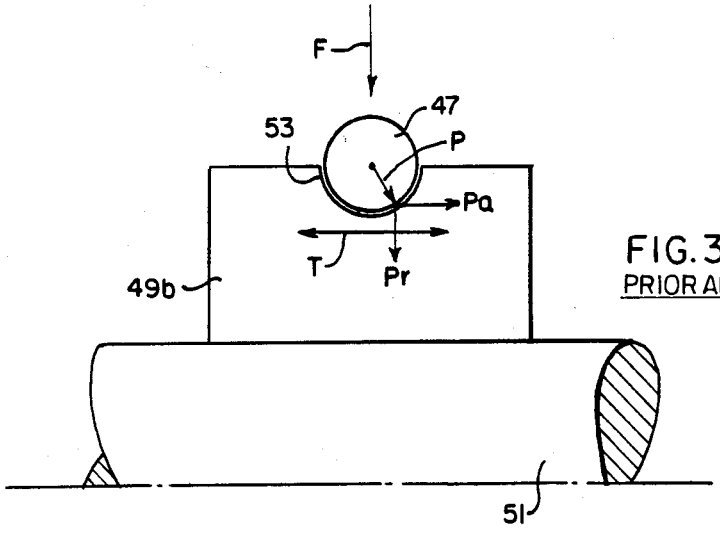
FIG. 3. PRIOR ART
FIG. 3 is a fragmental diagrammatic view showing the parts of prior-art pilgering apparatus involved in the problem which gave rise to this invention and illustrating why the problem arises.

FIG. 3 shows a bottom die 49*b* on a shaft 51 in prior-art pilgering apparatus for reducing a tube 47. The reducing force is represented by the arrow or vector F. With respect to its effect on the part of the die above the lowest point of the groove 53, the resulting pressure P acting on the groove surface may be resolved into a radial component Pr and an axial component Pa with respect to the die axis. This pressure, Pa, is applied to opposite sides of the groove 53 in directions such as to open the groove 53 and its tendency is to produce a resisting tensile stress and thus cause the dies to fail in the region of groove 53. The pressure P is high and to withstand this pressure the die 49 is case hardened in the region of the groove 53. Case hardening produces the required strength to resist the compressive stresses in the groove surface. Case hardening, as opposed to complete or through hardening, also produces a residual compressive stress in the hardened case which has the further advantage of resisting the above, detrimental tensile stresses. While case hardening does significantly improve die life more than through hardening, dies still ultimately fail by cracking under prior-art practice. Therefore improvement in accordance with this invention is needed to improve die life. The improvement according to this invention enhances the performance of the case-hardened die. In addition in some situations the invention is so effective to suppress cracking due to tension as to permit replacing case hardening by through hardening.

Figure 4:
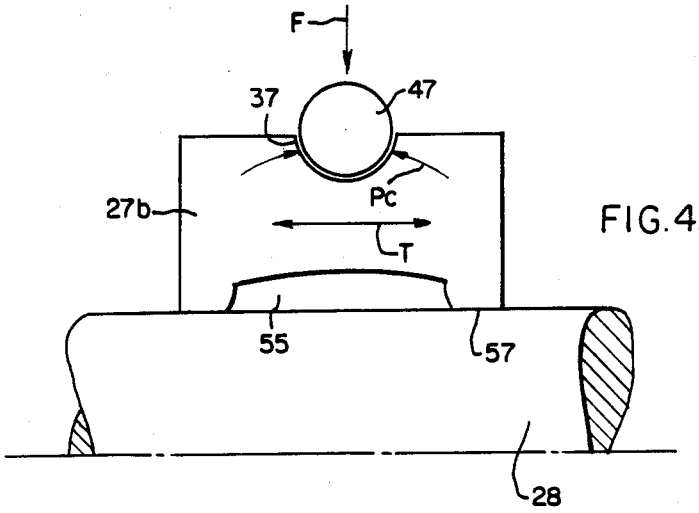
FIG. 4 is a fragmental diagrammatic view showing parts of pilgering apparatus similar to those shown in FIG. 3 but embodying this invention.

FIG. 4 is illustrative of the invention. Each die 27*t* and 27*b* is provided with a recess 55 in the bore 35. The recess extends circumferentially around the die bore describing a ring which is coaxial with shaft 28. Dies 27*t* and 27*b* are shrunk onto their associated shaft but only at surfaces 57 of the bore where they engage the shaft on each side laterally of the recess 55.

Figure 5:
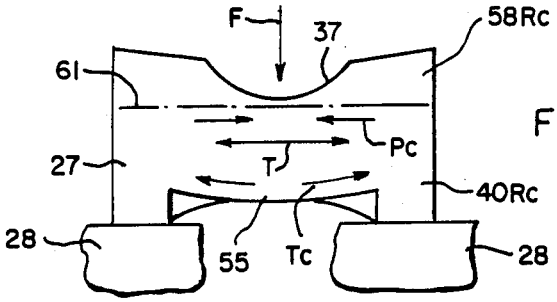
FIG. 5 is a fragmental diagrammatic view of a die in accordance with this invention, subject to the tube reducing pressure, showing the manner in which the tension in the region of the groove is compensated.

The manner in which the tendency of a die 27 to fail is precluded or minimized is illustrated in FIG. 5. Under the force F, the die is deflected between its supports 57 on the shaft 28. The deflection is shown exaggerated in FIG. 5. The fibers of the metal in the region of the recess 55 are subjected to tension Tc and the fibers of the metal in the region of the groove 37 are subject to compression. The compression Pc counteracts the tension T produced by the pilgering force F reducing the tendency of the die to fail. The volume of the die in the region of the groove 37 is case hardened and typically has a Rockwell C hardness of 58. The case hardening only extends a short distance 61 below the groove 37. In the region of the recess 55 the hardness is typically 40 Rc. The metal in the region of the recess 55 is resistant to failure by tension Tc because the core material is more ductile and thus tougher. Also tension Tc acts alone, in contrast to the tension in the groove, and thus the material is not effectively weakened by the existence of biaxial tensile and compressive stresses as discussed above. Depending on the extent of the bore recess, it is possible to develop, by flexing, sufficient compressive stress in the groove area to eliminate the need for the compressive residual stresses produced in the hardened case in the groove area and thus eliminate the need for case hardening entirely.

Figure 7:
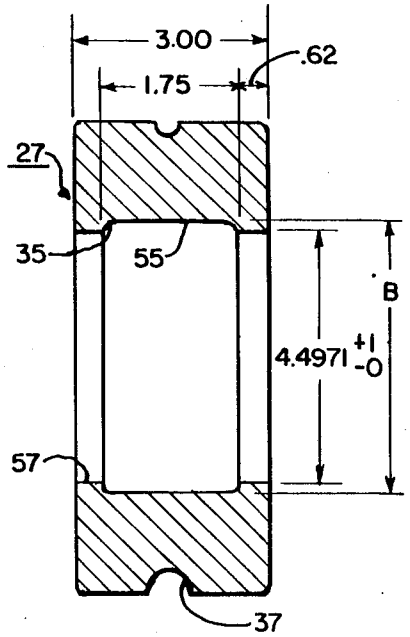
FIG. 7 is a view in longitudinal section taken along line VII—VII of FIG. 6.
Figure 8:
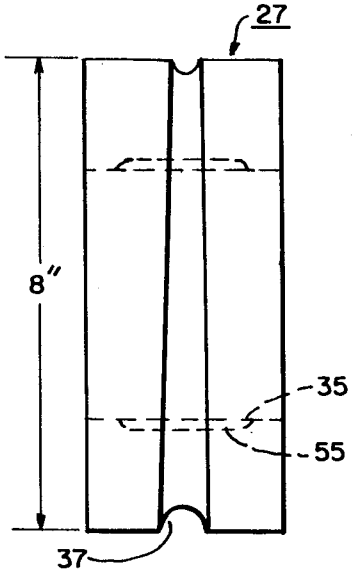
FIG. 8 is a view in side elevation of the die shown in FIG. 6.
Figure 6:
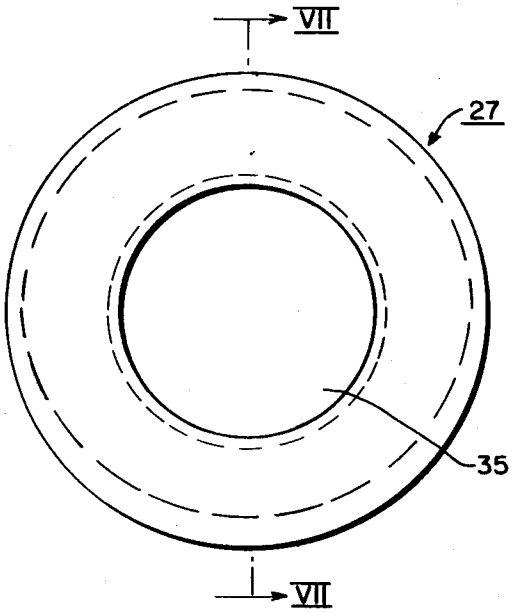
FIG. 6 is a plan view of a die in accordance with this invention.

FIGS. 7 and 8 show typical dimensions of a die 27 in accordance with this invention. The dimensions are for the dies which would be used in the final reduction operation of the tube 43 described above; namely, the reduction of OD from 0.700 inch to 0.375 inch and the reduction of the thickness from 0.070 inch to 0.023 inch. As indicated the diameter of the bore at the walls 57 which engage the shaft 28 is $$4.4971\ ^{+1}_{-0}$$

In FIG. 7 the dimension B represents the diameter of the bore 35 along the recess 55; i.e., B measures the depth of the recess. Dies with the following magnitudes in inches for B were used $$4.500\ ^{+1}_{-0}$$

$$4.520\ ^{+2}_{-0}$$

The length of the taper of the groove 37 in each die 27 is typically 9 inches. At the greater radius end the groove has a diameter of 0.705 inch, 0.005 greater than the starting OD of the tube 47. At the smaller radius end the groove has a diameter of 0.372 inch, 0.003 less than the reduced diameter of the tube. For the purpose of identifying where, along the tapered groove, an observation for analysis purposes is made, the groove is subdivided into stations. Each station is identified by a decimal equal to the ratio of its distance from the smaller radius end to the larger radius end along the tapered portion of the groove. The smaller radius end of the taper is at station 0 and the larger radius end is at station 1. A station identified by the decimal 0.2 is at a point displaced from station 0 by 20% of the distance from the smaller radius end of the groove to the larger radius end. The sizing area is beyond station 0 in the direction away from the smaller radius end. Typically for a die of the dimensions described above, the sizing area extends about 4 inches from station 0. In the direction away from station 1, the groove 37 has at least the same radius as the greater radius at the end of the taper for about 2 inches in the die described above.

Figure 9:
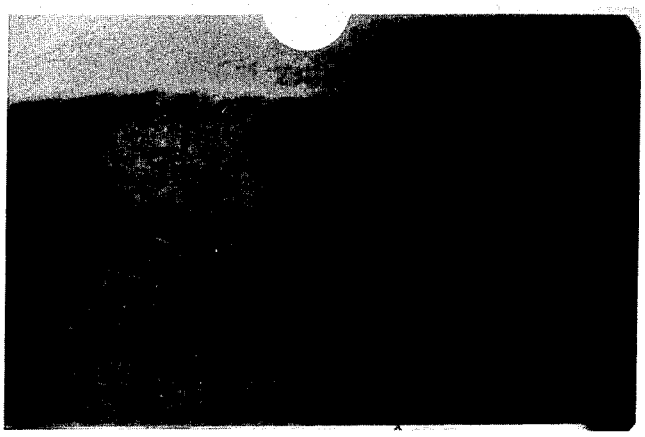
FIGS. 9 and 10 are copies of photomacrographs showing the regions in which the top and bottom dies respectively as positioned in the pilgering apparatus, are case hardened.
Figure 10:
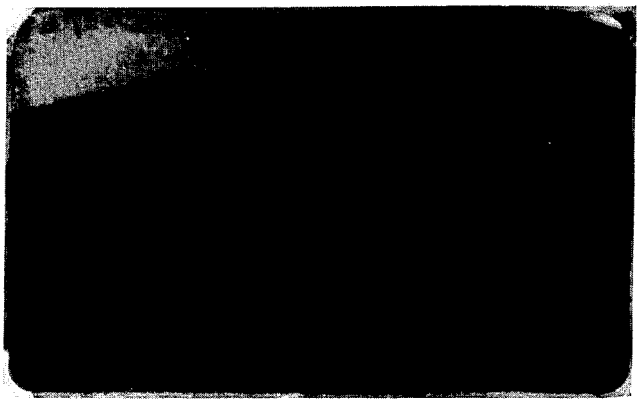

FIGS. 9 and 10 are photomacrographs of the top die 27*t* and the bottom die 27*b* taken for a cut at station 0.2. In each case the lighter or gray area 71 shows the case hardened region to the cut. The case hardening of each die extends throughout an annular strip whose OD is the distance from axis to the outer surface of the die and whose ID is the distance from its axis to the inner boundary of the case hardened portion 71. It is seen that the case hardening extends only a small distance inwardly of the groove 37.

Figure 11:
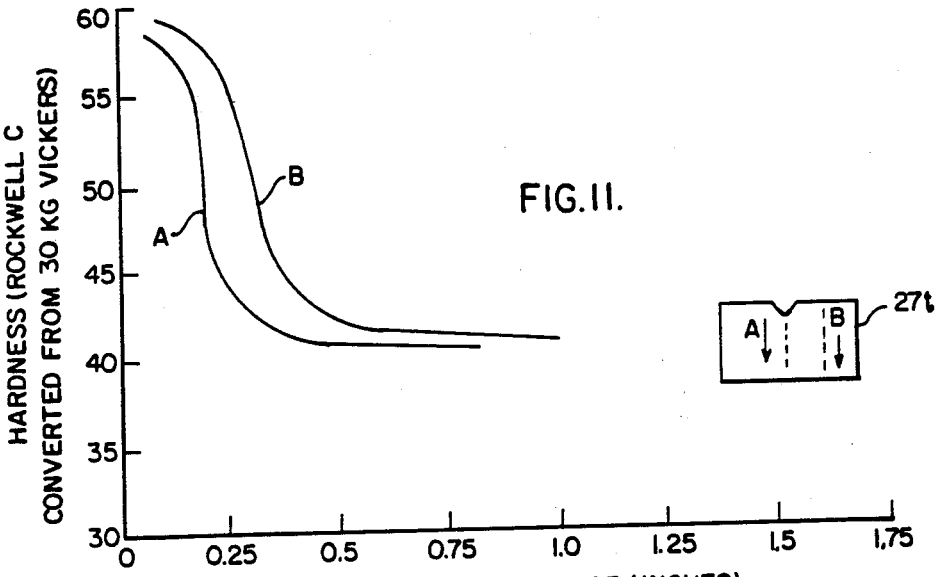
FIGS. 11, 12, 13 and 14 are graphs showing the hardnesses of the top and bottom dies, as positioned in the pilgering apparatus, as a function of the depth in the region of the groove at various positions along the dies.
Figure 14:
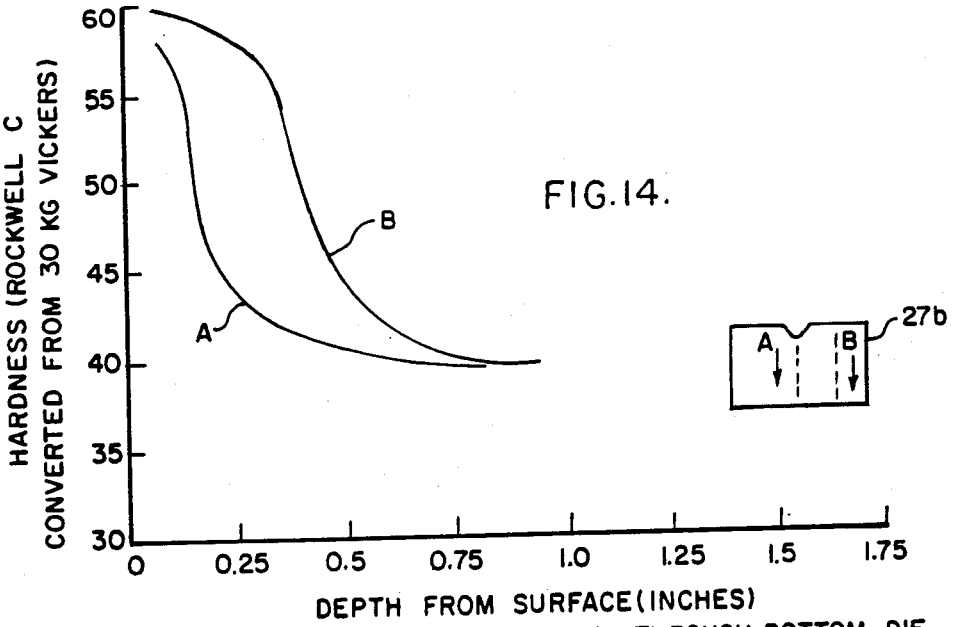
Figure 12:
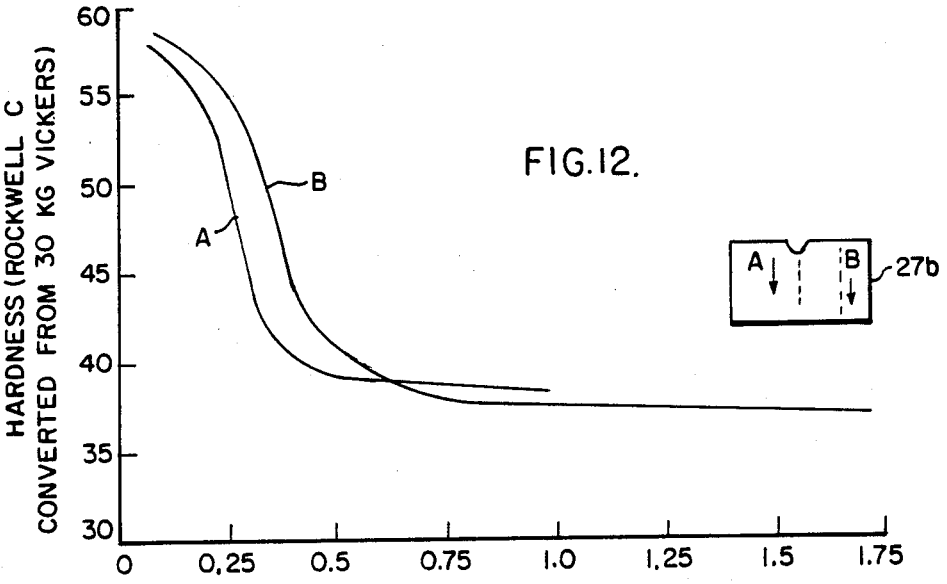
Figure 13:
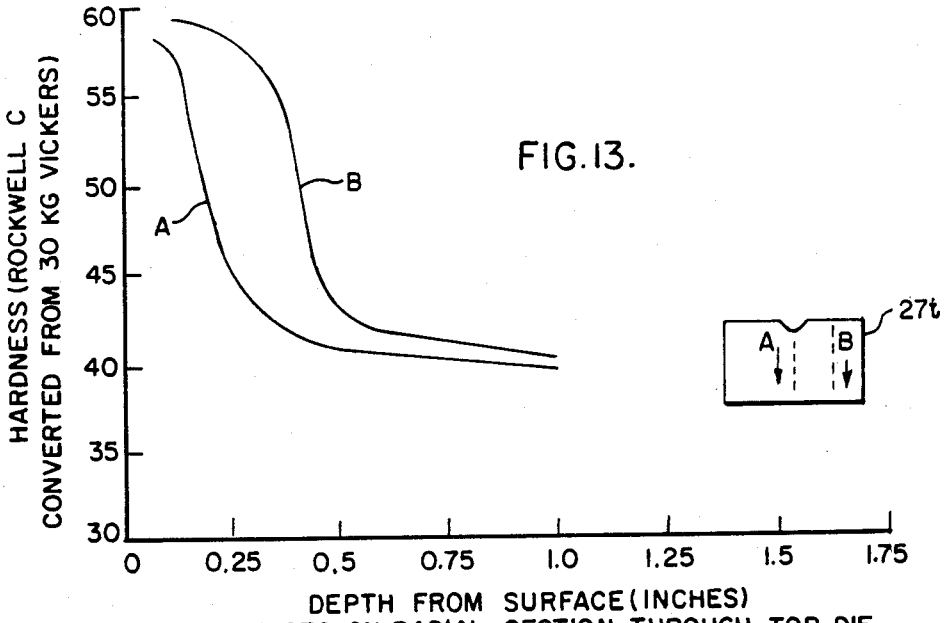

FIGS. 11 through 14 show the extent of the case hardening at different stations along the die and confirm that the hardening extends throughout an annulus. In each graph hardness in Rockwell C is plotted vertically as a function of the depth in inches from the outer surface or from the top of the groove in inches. In each case the distance for curve A is measured from the base of the groove and the distance for curve B is measured from the outer surface or tread of the die. FIG. 11 shows that the case hardening at station 0.25 of the top die 27*t* extends to about one-half inch below the tip of the groove. FIG. 12 shows the same property for the bottom die 27*b* at station 0.20. FIGS. 13 and 14 show the same properties for the top and bottom dies respectively at station 0.70.

While preferred embodiments of this invention have been disclosed herein, many modifications thereof are feasible. This invention is not to be restricted except insofar as is necessitated by the spirit of the prior art.

What I claim is:

1. Pilgering apparatus for reducing a tube, said apparatus including a mandrel on which said tube is to be mounted, a roll stand, means, connected to said roll stand, for oscillating said roll stand, bearing blocks on said roll stand, a pair of dies mounted rotatable and cooperatively on said bearing blocks, each said dies having a groove of generally circular configuration in its outer peripheral surface, the transverse cross section of each said groove being circularly arcuate, the radius of the cross section of said each groove decreasing progressively circumferentially around the groove, each said die also having a bore defining its inner peripheral surface, a drive shaft, connected to said bore, for rotating said each said die as said roll stand is oscillated, said dies being so mounted that the bounding edges of their grooves progressively come into tangency as the dies are rotated and in the region where the edge of the grooves come into tangency, the radius, of the groove of one die being substantially equal to the radius of the groove of the other die at each position of tangency, whereby as said dies are rotated the contiguous portions of the grooves form a channel of generally circular cross section of progressively decreasing radius, said mandrel being positioned to extend said tube into said channel into engagement with said dies as said roll stand is oscillated and said dies are rotated, whereby as the cross-sectional radius of said channel decreases said dies exert force on said tube to reduce said tube, each said die having a peripheral recess in its said bore, each said recess being coaxial with said groove of its corresponding die and with the axis of its corresponding drive shaft and extending radially towards its corresponding groove, whereby each said die is flexed on the portion of its bore bounding its recess by the force applied to reduce said tube and the stresses developed in said dies by the said force is counteracted by stresses developed by said flexing.

2. The pilgering apparatus of claim 1 wherein each die is case hardened in the portion of its volume encompassing the groove, including the region in which the stress resulting from the pressure applied to reduce the tube predominantly exists, but is not hardened in the portion of its volume encompassing the recess, including the region where the tensile stress resulting from the flexing predominantly exists, where the tendency of the die to fail under the stress produced by the flexing is materially lower.

3. A die for pilgering apparatus for reducing a tube, said die including a member capable of being rotated having along its outer periphery a generally circular groove whose transverse cross section is a generally circular arc, the radius of said arc decreasing progressively from a first point along its outer periphery to a second point along said periphery, said member also having internally a bore bounded by an inner peripheral surface for supporting a shaft, said inner peripheral surface being opposite to said outer surface and having a recess generally coaxial with said outer surface, said recess being bounded by projections on which said shaft is to be supported, whereby said member is flexed by the force applied to reduce said tube and the tensile stress produced in the region of said groove by said force is counteracted by the compressive stress produced by the flexing of said member.

4. The die of claim 3 wherein the portion of the volume of the member encompassing the groove, including the region where the stress resulting from the pressure applied to reduce the tube predominantly exists, is case hardened, and the volume of the member encompassing the recess, including the region where tensile stress resulting from the flexing predominantly exists, is not hardened, whereby the tendency of the member to fail under the tensile stress resulting from the flexing is materially lower.

5. The die of claim 3 wherein the entire volume is hardened to the high level of hardness required for pilgering which includes the region where the stress resulting from the pressure applied to reduce the tube predominantly exists and the volume of the member encompassing the recess including the region where tensile stress resulting from the flexing predominantly exists whereby the tendency of the member to fail under the singular tensile stress resulting from the flexing is significantly lower.

6. The method of suppressing cracking of a die of pilgering apparatus for reducing a tube, said die having a groove on an outer peripheral surface of said die in which said tube is to be subjected to substantial reducing force, said die having a bore generally coaxial with said groove for receiving and being supported by, a drive shaft, said bore defining the inner peripheral surface of said die, said bore having a recess generally coaxial with said groove and with the axis of said shaft and extending radially towards said groove, said die being supported on the portion thereof bounding said recess; the said method comprising positioning a tube in the groove of said die, applying force to said tube through said die to impress reducing pressure on said tube, said reducing pressure being transmitted through said tube to said die and being manifested as compressive stress against the groove surface, said compressive stress producing tensile stress generally parallel to the axis of said shaft in the region of said groove and flexing said die on said supporting portions producing compressive stress generally parallel to the axis of said shaft in the region of said groove to counteract said tensile stress in said region.

* * * * *